United States Patent [19]

Van Dijck

[11] 4,158,372

[45] Jun. 19, 1979

[54] PROCESS AND DEVICE FOR WATCHING THE WEFT ON WEAVING LOOMS

[75] Inventor: Frans S. Van Dijck, Langemark, Belgium

[73] Assignee: N.V. Weefautomaten Picanol, Ieper, Belgium

[21] Appl. No.: 778,969

[22] Filed: Mar. 18, 1977

[30] Foreign Application Priority Data

Mar. 29, 1976 [NL] Netherlands ..... 7603258

[51] Int. Cl.[2] ..... D03D 51/34

[52] U.S. Cl. ..... 139/370.1; 250/561

[58] Field of Search ..... 139/336, 340, 370.1, 139/370.2; 66/163; 250/548, 559, 561, 562

[56] References Cited

U.S. PATENT DOCUMENTS

| | | | |
|---|---|---|---|
| 3,298,401 | 1/1967 | Stutz | 139/371 |
| 3,358,717 | 12/1967 | Schooley | 139/341 |
| 3,440,634 | 4/1969 | Maurmann et al. | 139/370.2 |
| 3,593,756 | 7/1971 | Vella | 139/371 |
| 4,023,599 | 5/1977 | Zeleny | 139/370.2 |
| 4,031,924 | 6/1977 | Domig et al. | 139/371 |

*Primary Examiner*—Henry Jaudon

*Attorney, Agent, or Firm*—Bacon & Thomas

[57] ABSTRACT

The invention pertains to a process for watching the weft thread of weaving looms, characterized by the fact that it consists in preparing a stop signal for the weaving loom, each time the weft carrier has completely left the shed; in checking for the presence of the weft thread behind the weft carrying means, just outside the shed, and in cancelling aforesaid stop signal if thread is present, respectively in making use of the stop signal if thread is absent.

4 Claims, 4 Drawing Figures

PROCESS AND DEVICE FOR WATCHING THE WEFT ON WEAVING LOOMS

The invention pertains to a process and a device for watching the weft of a weaving loom, more particularly in order to stop the loom in the case of failing weft thread behind a shuttle, projectile or any other weft carrying means at the outlet of the shed.

Due to the ever increasing weaving speed, the original mechanical weft watchers had to be replaced by faster acting devices.

Hence, there exist numerous patents, such as German Pat. No. 876,679, German Pat. No. 1,410,731, French Pat. No. 1,343,670, Dutch Pat. No. 280,995, Swiss Pat. No. 455,671, and Belgian Pat. No. 829,245, in which devices are described consisting of combinations of electrical, electromechanical, electrovibratory, electromagnetic, optical- or photoelectric, electronic induction means, have been incorporated in the weft carrier and on the race board or along the weft path, whereby attempts are made to establish a faster and infallible checking of the weft breakage. These mostly very sensitive, expensive and elaborate apparatus remain extremely difficult to adjust. They suffer from the shocks and vibrations caused by the picking, the race board and the shed forming devices, and do not operate in a uniform manner with the various thread thicknesses and kinds of weft. The continuous contact and friction of the weft thread causes many weft breakages. Fast wear, mainly by hard synthetic threads, and unadjustment render the automatic looms with ever increasing speed of rotation, and which are fitted therewith, rather unproductive.

Simultaneously with the previous weft detectors, contactless optical, photoelectric or magnetic watching devices for moving objects, in this case the weft thread, were developed for a fixed point and instant of time on the crankshaft setting, consequently synchronized with the weaving cycle, or according to a predetermined programmation (examples: German Pat. No. 1,192,988, German Pat. No. 1,535,398, German Pat. No. 2,255,922, Swiss Pat. No. 396,803, Belgian Pat. No. 695,195 and U.S. Pat. No. 3,532,138).

This contactless weft detection is mainly for application to modern automatic looms with electromagnetic drive and electronically programmed supervision. They seem however not to be able to cope with all thicknesses and varieties of weft, which causes wild stoppages. The soiling of lenses, the elaborate and expensive apparatus, require extra precautions and complicated building structures. The watching of the weft at a fixed point and time instant of the crankshaft rotation does not permit infallible weft supervision, because of the sometimes too early operation of the weft watcher due to fluctuations in speed of the weft carrier. The continuous vibrations of the fast automatic looms sometimes cause variations of light ray intensity with the optical devices known so far, such as for instance light sources with heat coils. The optical reflection solutions with mirrors require complicated and expensive lenses, whereby the diaphragms cause heating.

Due to the fact that the shuttle location or the location of any weft carrier is never the same at the race board for the same angular positions of the crankshaft, so that also the weft location is never the same for equal race board position and crankshaft angular position, considering the variations of weft carrier speed, some devices have for instance probed the absence of weft thread behind the weft carrier on leaving the shed, or the presence of the weft thread on the pirn, after having first detected the shuttle on leaving the shed or in the shuttle box.

In Dutch Pat. No. 125,998, for instance, we find the description of an apparatus in which the check is operated after the weft carrier, on leaving the shed. No consideration is given here however to the thread tension itself which, however slight, will transmit an absence of weft signal due to the fact that the thread will fly past point A sideways.

The fabrication standards still retain some disadvantages of the previously mentioned contactless optical detectors. Moreover, such a means of checking is not appropriate for the present high speeds, as the stopping signal is not prepared by the shuttle and must still, in the absence of weft, be transmitted to the loom drive, mostly resulting in too late a stop, so that faulty wefts and suchlike are incorporated in the weaving.

In a device such as described in U.S. Pat. No. 3,563,281, the weft thread detector is only switched off when the weft carrier has reached a certain point in the brake bench. The detection takes place by a continuous contact with the weft thread, practically over the entire length of the weft path, and is based on sufficient or unsufficient thread tension. In this case the weft detector is thus switched off as soon as the weft carrier is out of the shed and in the picking box. Although the weft thread can continually be watched, the friction caused by the continuous contact of the weft thread with the feeler is very detrimental to tender fibres (glass, silk, a.o.). On the other hand, the whole device is rather elaborate and makes use of a predetermined crankshaft angular position.

In Swiss Pat. No. 485,054 and German Pat. No. 2,204,529 optical and photoelectric weft thread watchers are provided, which operate after the weft carrier has left the shed and is in the catcher.

The previous patents all have the advantage of absorbing the irregular, weft carrier speeds, whereby the weft carrier never lands in the catcher at the same time and consequently at the same angular position of the crankshaft. They do however have the disadvantage, apart from being complicated and elaborate, that it is only after having detected the weft carrier that they make a check of the weft and possibly, in the absence of weft, emit a stop signal or switch order to the drive of the weaving loom. As the present speeds of the automatic looms have become so high, the stoppage or switch in many cases occurs too late when controlled by the aforementioned optical, photoelectric or even electronic devices.

In Swiss Pat. No. 489,642 we also find a weft thread watching device which practically checks the weft thread continuously right from picking to standstill of the shuttle, so as to be able to produce a stop signal in case of breakage or disturbance at any location during the entire flight of the weft carrier. Although very ingeneous, even this system is elaborate, with rather complicated circuits and control mechanisms. Moreover, it does not work contactless. It does permit a rapid stopping of the loom, but the reed does beat in the broken weft when the breakage occurs towards the end, on leaving the shed. Idn our opinion, it is not necessary to provide an as elaborate as lengthy check over the entire length of the shuttle flight. It is well known that most breakages occur just behind the weft carrier (in this case projectile) and mostly at the beginning of the flight. As on the present modern electronically controlled weaving looms the picking takes place so fast, it is only necessary to impose a watching task at the end of the flight in order to determine the presence of the weft with certainty. By means of the aforementioned watching and stopping devices, it is however not possible immediately to stop the loom at the end of the weft carrier flight, i.e. at the last (ultimate) checking point, even on automatic looms which are provided with electromagnetic and electronic control. Trailings, or broken thread ends from the feeler, or swaying behind the weft carrier, are mostly woven in, because the detector has felt this faulty weft as a normal thread. This device is not appropriate for conventional weaving looms and remains limited to projectile looms with weft entry in one sense only.

Consequently, a first and main purpose of this invention is to provide a process and a device, which makes possible to stop the weaving loom in time, in the case of any possible sort of weft failure or absence of weft, even at the extreme end of the weft carrier flight, without this mispick being woven in. The process according to the invention mainly consists of the preparation of a stop signal for the weaving loom each time the shuttle, the projectile, or any other sort of weft carrier has completely left the shed; of checking the weft thread behind the shuttle or weft carrier; and of cancelling the stop signal if a weft thread is detected.

A second purpose of this invention is to provide a device which makes the realization of this process possible.

A further purpose of this invention is to provide a combination with small, very simple but trustworthy means, so that this device may be applied without noteworthy difficulties to the most modern weaving looms, without particular alterations.

Another characteristic of this invention is that one of these means, amongst others for carrying out the check of the thread, consists of a novel miniature emitter-reflector-receiver which, despite its reduced dimensions, is capable of picking up in its concentrated pencil of rays any thickness or type of thread, as well as any weft or tensional deviations. This small optical-electrical device is troublefree and can, due to its small volume, be fitted anywhere and in whatever manner to a weaving loom, so that its pencil ray is always directed in the path of the weft flight. It requires little or no adjustment. It is an optical-electrical apparatus, for the watching of threads or other moving objects, with multiple reflection of a concentrated beam of light. Use is made here of a most advantageous arrangement and hook-up of a diode together with photo-transistors and a second pilot diode.

Various optical and other wire checking apparatus are known which make use of the multiple reflections of a source of light. Most of them use a set of mirrors, such as for instance U.S. Pat. No. 3,489,910. This hook-up of two reflectors does indeed permit always to pick up the weft thread by means of a curtain of reflections, and to cause the weft breakage stop with certainty in case of any absence. It does however require a relatively elaborate device which has to be precision adjusted, and which is consequently rather expensive. In practice, it rapidly gets out of adjustment or damaged, due to the vibrations and shocks of the very fast automatic weaving looms.

As stated previously, it is a known fact that the use of diaphragms and lenses creates problems. They require considerable space, which is undesirable on a weaving loom, much energy or power consumption, which is uneconomical, particularly in large weaving halls. Diaphragms cause heating and lenses are expensive.

All these devices do however use a too scattered reflected pencil of light rays, so that when the weft thread passes through it, a spot of shadow is caused (unless a source of light with heavy current consumption is used). The detection is too wide and consequently weakened, thus not activated by a thread presence, and causing false stops. This is also the reason why the known photo-electric, or optical devices and suchlike, which probe the supply of thread on the pirns, are not appropriate for the checking of weft thread breakage. For the latter, the pencil of light must be concentrated. One concentrated pencil of light is however not enough. It would not pick up slight thread flight deviations. These must also be reflected, but in such a manner that no light is lost.

In French Pat. No. 1,286,254, the weft check is carried out at the rear of the shuttle after having left the shed, by means of a complicated rotating system of emitter and polygonal mirror-reflectors, which reflects a concentrated ray of light upon a photo-electric diode (or photo-element). This device is also repidly damaged by vibrations and shocks of the fast automatic weaving looms, and has the disadvantage of all mirror-reflectors.

The application of a light emitting diode for the optical check of the weft thread is known, such as for instance in U.S. Pat. No. 3,532,138. This is a current saving solution, less elaborate and less expensive. This arrangement does however merely make use of the power of the single ray of light emitted by the light diode and directed upon a light sensitive cell. It is fitted at the entrance of the thread-end sucking off device. Deviations of the thread ends can however cause false stops. The entire entrance is not covered by the single ray of light. A further inconvenience consists in the fact, that a possibly broken off thread end, at the beginning or in the middle of the shed and which waves about behind the shuttle, may also be taken up in the sucking up checking device. Finally, this arrangement can only be used on looms with pirnless shuttles.

In Belgian Pat. No. 704,347 the question is raised of a light diode, which makes use of a gallium arsenide diode instead of a glow lamp for the scanning of moving objects such as pirns in weaving looms. The device illustrated in this case, in which a wide source of light is directed upon an empty pirn, which reflects the ray of light in a scatterd manner towards two photo cells, for controlling the switch, is only applicable in its pirn scanning function. It cannot work as thread watcher, due to the fact that the open ray of light is focussed in such a manner, that when reflected it gives rise to a large light shadow, when the weft thread comes into its pencil, so that the influence of the thin thread upon the spread out pencil of light is so weak, that the receiver does not react and supplies a (false) stop signal. All the more so, because photo cells or photo elements are being used as receivers, and these always cause a voltage drop (max. 0.8 V) from the light they receive, and consequently further weaken the light ray intensity. Finally, a photocell is larger and makes use of lenses, which get soiled. A photo-transistor on the other hand consumes no current, but the light it receives merely alters the adjustment thereof. This device is most certainly less elaborate than the previous scanning apparatus, but as mentioned before, it is not suited for weft breakage watching.

Finally, German patent application No. 2,429,261 mentions a weft watcher which takes up little space and can easily be fitted on the race board. It consists of an electromechanical (tribo-electric or piezo-electric) converter according to Swiss Pat. No. 479,478 for instance, which carries out a slanting scanning movement towards the shoot line, but is less cumbersome than the previously existing devices. This arrangement is however not contactless and wear free, and nevertheless remains relatively complicated. In practice, it is moreover not certain that the scanning element will always pick up the thread. It consequently requires repeated adjustments.

In a first form of embodiment of the process according to the invention, the creation of the stop signal may be effected by means of a pick-up fitted in the fixed wall or moulding of the box, on either side of the weaving loom, in the case of a shuttle loom, and by a magnet provided at each end of the shuttle, in such a manner that the impulse signal is reactivated on the lefthand side as well as on the righthand side, in the rotating programmator, which consequently has for each revolution once a signal (1) and the next revolution a signal zero (0). These signals are used for directional selection of the system.

In a second form of embodiment of the process of this invention, the creation of aforementioned stop signal may be produced by means of the shuttle, in the case of a shuttle loom, which interrupts the optical pencil of rays from the emitter-receiver, and brings about a rectangular signal, passing from 1 to 0, as long as the shuttle remains in the ray. At the instant when the shuttle is past, the signal passes from 0 to 1, and this change in level of the optical emitter-receiver is used to produce the stop signal.

It is only the first form of embodiment which will be described more in detail hereinafter, considering that the operating principle of the weft breakage watching is the same in both forms of embodiment. It is only the stop signal which is activated respectively magnetically and optically. The operating process in both examples is fundamentally identical.

The following description thus pertains to above-mentioned first form of embodiment, applied to a weaving loom with shuttle, whereby reference is made to the appended drawings in which.

Figure 4:
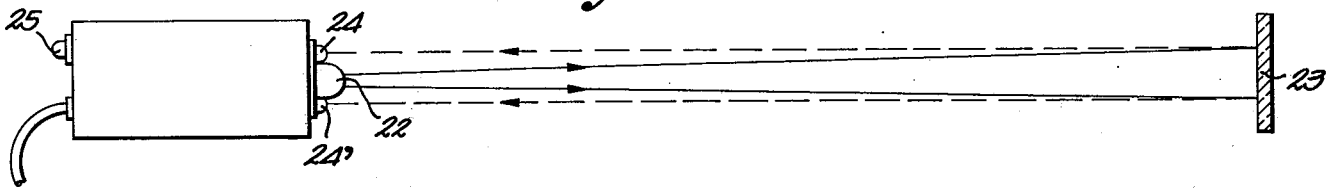

FIG. 4 gives a side view of one preferred arrangement of the optical checking part, such as is preferably used in this invention, and which can serve the purpose of a source of light.

Figure 1:
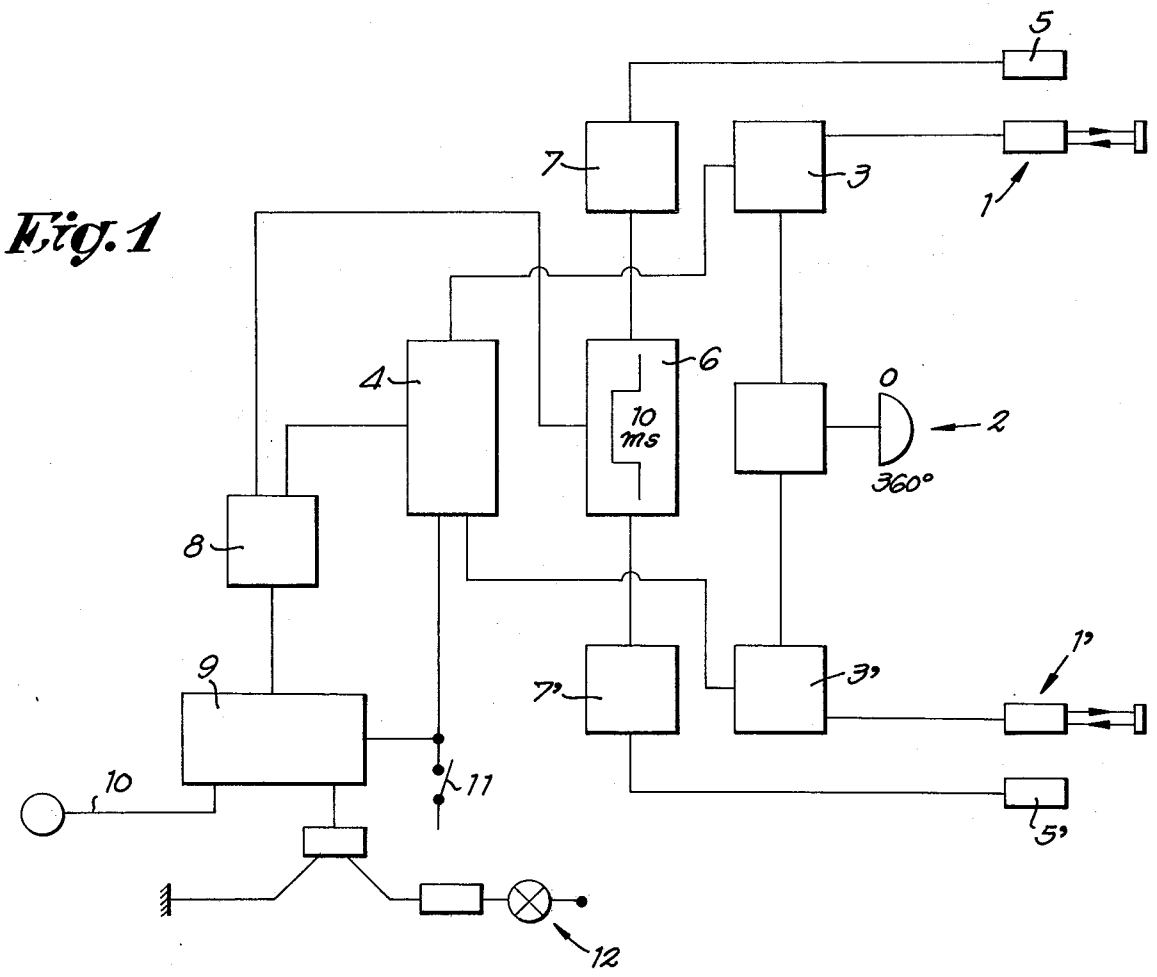
FIG. 1 shows the block diagram or circuit of the watching arrangement on a weaving loom.

In the block diagram (FIG. 1), two sets of emitter-reflector-receivers are shown, respectively 1 and 1' and two sets of induction recorders, namely 5 and 5'. They are fitted on either side of the race board in the fixed box walls of a shuttle weaving loom equipped with mechanical, electromagnetic and (or) electronic control, and well known as such. These two emitter-reflector-receivers 1 and 1' are alternately connected by means of a left-right selector 2.

The trigger signal produced by collectors 5 and 5' is transmitted via the amplifiers, respectively 7 and 7', to a monostable 6 and a bistable 4, which forms the memory of the stop signal. The signal produced by receivers 1 and 1' is transmitted via the amplifiers, respectively 3 and 3', to a bistable 4 which forms memory and is reset by the signal. This occurs during a period of time of maximum 10 ms supplied by the monostable 6.

The outputs of the mono- and bistables, respectively 6 and 4, are present at the NAND gate 8, the output signal of which is then sent to a bistable 9. After the end of the running time of 10 ms or less (due to monostable 6), and considering that bistable 4 has been reset, no alteration appears at the output of NAND gate 8, so that bistable 9 is not activated and the weaving loom continues to run. This is therefore the case when after the passage of the shuttle, the weft thread is still present.

In the case when the shuttle passes and consequently places a stop signal in memory, but no weft thread follows, so that no signal is produced by receivers 1 and 1', then the stop condition of bistable 4 remains valid, and after the running time of 10 ms of monostable 6, considering that the outputs respectively of mono- and bistables 6 and 4 are interlocked during a maximum of 10 ms and that bistable 4 remains in its stop condition, the output of NAND gate 8 is altered so that bistable 9 reacts, the output 10 of which then transmits the stop order to the weaving loom control or drive. The optical monitor 12 is also operated and witnesses weft breakage. Reset 11 is used for the resetting of bistables 4 and 9, after each stoppage at the restart of the weaving loom.

In practice, an interlocking of bistables 9 and 4 during 5 to 6 ms would be sufficient for cancelling the prepared stop signal, or not. With 10 ms however, a wider safety tolerance is obtained, which may take up possible deviations. By means of this arrangement of the weft watching control, the weaving loom can be stopped within 50° at the most after detection.

Figure 2:
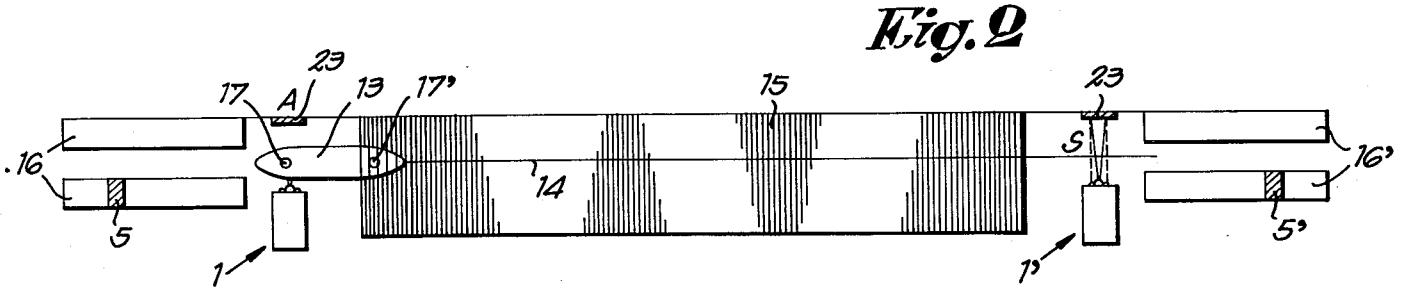
FIGS. 2 and 3 show a schematic representation of the process according to the example in the first form of embodiment, which is being described here.
Figure 3:
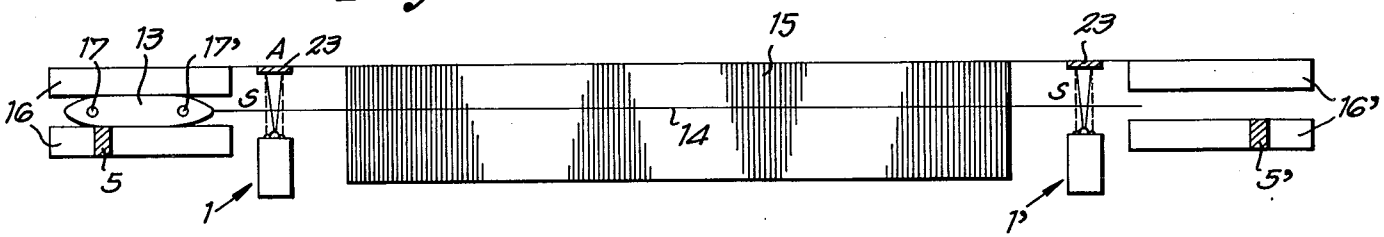

We find indeed, that on leaving the shed 15, shuttle 13, provided at its end with a magnet 17 (or 17'), will, by means of the trigger induction coil 5 (or 5') in fixed box wall 16 (or 16') of the loom, place the weft watching device in its stop condition, generally between the crankshaft angular positions of ±282° to 285°. The spirally unwinding weft thread 14 immediately behind the shuttle 13 (FIGS. 2 and 3) cuts the concentrated multiple pencil of rays S (FIG. 3) produced by emitter receiver 1, when the thread reaches position A. The impulse which is supplied at that moment by the pick-up cancels the stop condition so that the loom runs on unhampered.

If however thread 14 behind shuttle 13 does not pass position A, and does consequently not interrupt the pencil or rays from 1, the pick-up will not create an impulse. The end of the watching is located at ±300° and the point of rotation of the angular position of the crankshaft has reached ±300°; the loom will then stop at ±350° (braking ±50°). The checking time is of 10° shaft rotation, which corresponds approximately to 6.94 ms when the loom rotates at 250 r.p.m., which is sufficient as checking time.

The entire circuit can be included on a printed card, which can be connected into the existing control system of any type of loom whatever.

A preferred form of embodiment of the light emitter reflector receiver, used in this process (FIG. 4) shall however preferably consist of an LED diode 22, fitted on the race board, which emits a concentrated beam of light towards reflector 23 on the frame, with a very high concentration. This ray of light is reflected and returns as a pencil of light in the same direction, parallel with the light ray of the LED diode 22, and is picked up by 1 or 2 photo transistors 24 and 24' which are coupled parallel with the light diode, and thus receive the reflecting pencil of light. The circuit is designed in such a manner, that the slightest darkening or reduction of intensity of the emitted ray or reflected pencil of rays will produce a signal, which is amplified and sets off the entire electronic control procedure previously described. A LED diode 25 is fitted behind the light emitting apparatus as a checking unit, in order to adjust the light ray of LED diode 22 in such a manner, that the reflected light ray is received in the best possible manner.

This arrangement thus uses one finely concentrated ray of light, which reflects back at least two finely concentrated parallel rays of light. There are consequently three spots, which are sufficient for picking up the passage of fine thread with certainty. The LED diode used shall preferably be fitted with a 4° lens, which sends a ray of light of 7 to 8 mm on the reflector, whereby the latter sends back concentrated rays via the reflector to the photo transistors, which in accordance with their previously mentioned properties have no voltage drop. The bulk and consequently the space taken up by the entire device does not exceed 35 mm in length for a diameter of 20 mm.

This arrangement of emitter-receiver allows sufficient free play to be able to cope with any thread deviations of nature, location, quality and suchlike more. There are consequently no repeated adjustments required. The checking LED diode as monitor permits an easy adjustment of the ray of light when starting up the weaving loom, either by the weaver or even by an unskilled hand. No adjustments are therefore required for thread thickness and suchlike, but merely for the flight path of the shuttle.

The entire process as illustrated above lends itself preferably and to the best advantage for the use on automatic weaving looms provided with electronic drive, as described for instance in U.S. Pat. No. 3,805,849 Austrian Pat. Nos. 317,107 and 329,469.

The invention is not limited to the forms of embodiment described above. It can just as well be realized with other means and/or be practically altered for use also on shuttleless weaving looms, such as these with micro shuttles, projectiles, rapiers or other weft carriers.

What I claim is:

1. The process for watching the weft thread of weaving looms, comprising the steps of: generating a stop signal for the weaving loom in response to the weft carrier leaving the shed; checking for the presence of the weft thread behind the weft carrying means, just outside the shed, and cancelling aforesaid stop signal if thread is present, and causing said stop signal to stop the loom if thread is absent; said stop signal being produced by an optical emitter-receiver and a reflector, one of which is fitted to the race board and the other on the frame, a pencil of light of which is interrupted by the weft carrier.

2. The process for watching the weft thread of weaving looms, comprising the steps of: generating a stop signal for the weaving loom in response to the weft carrier leaving the shed; checking for the presence of the weft thread behind the weft carrying means, just outside the shed, and cancelling aforesaid stop signal if thread is present, and causing said stop signal to stop the loom if thread is absent; said stop signal being generated previously to the ascertaining of weft presence; the signal being produced by means of a pick-up fitted in each fixed box wall of the loom, and by a magnet which is located at each end of the shuttle, in such a manner that an impulse signal is activated on the lefthand side as well as on the righthand side in the rotary programmator, which at each rotation once has a 1 signal and at the next rotation an 0 signal, used for the choice of direction of the system; entering the stop signal in memory, detecting the weft thread presence after the shuttle passes the outlet of the shed, by contactless means, at a predetermined moment after the passage of the shuttle; in the absence of the weft thread retaining stop signal and bringing the loom to a standstill before the end of the weaving cycle; but when the weft thread is present, cancelling the stop signal so that the weaving loom proceeds with its next cycle.

3. The process for watching the weft thread of weaving looms, comprising the steps of: generating a stop signal for the weaving loom in response to the weft carrier leaving the shed; checking for the presence of the weft thread behind the weft carrying means, just outside the shed, and cancelling aforesaid stop signal if thread is present, and causing said stop signal to stop the loom if thread is absent; said loom being an automatic weaving loom with one sided weft entering, such as for instance with a projectile, gripper or multiple micro-shuttles, characterized by the fact that the stop signal is generated before the weft presence is scanned; the signal is produced by a pick-up which is incorporated in the catching or braking device of the weft carrier, and by a magnet which is located on the weft carrier, in such a manner that the impulse signal is generated on this side of the catching edge or brake box; entering the stop signal in memory; scanning by contactless means the presence of the weft thread at the outlet of the shed, within a determined period of time after the passage of the weft carrier; in the absence of weft thread causing the stop signal to bring the loom to a standstill before the end of the next weaving cycle; but in cancelling the stop signal in the case of the weft thread being present, and the weaving loom proceeds with the next weaving cycle.

4. The process for watching the weft thread of weaving looms, comprising the steps of: generating a stop signal for the weaving loom in response to the weft carrier leaving the shed; checking for the presence of the weft thread behind the weft carrying means, just outside the shed, and cancelling aforesaid stop signal if thread is present, and causing said stop signal to stop the loom if thread is absent; the generation of the stop signal being carried out by means of the shuttle or the weft carrier itself when the latter interrupts a pencil of rays from a transmitter-receiver on leaving the shed, and generates a rectangular signal, passing from 1 to 0, as long as the weft carrier remains in the ray; that the moment the weft carrier has past the ray, the signal returns from 0 to 1, whereby this alteration in level is used by the transmitter-receiver to produce the stop signal.

* * * * *